US005402972A

United States Patent [19]

Schmidt

[11] Patent Number: 5,402,972

[45] Date of Patent: Apr. 4, 1995

[54] APPARATUS FOR SUPPORTING A HUMAN FOREARM DURING A WORK OPERATION, SUCH AS A KEYBOARD OPERATION

[76] Inventor: Rainer Schmidt, 56472 Gotthardsweg 3, Nisterau, Germany

[21] Appl. No.: 282,982

[22] Filed: Jul. 29, 1994

[30] Foreign Application Priority Data

Jul. 31, 1993 [DE] Germany ..... 9311467 U

[51] Int. Cl.[6] ..... B63G 5/00

[52] U.S. Cl. ..... 248/118; 248/118.1; 248/918; 400/715

[58] Field of Search ..... 248/118, 118.1, 118.3, 248/118.5, 918; 400/715

[56] References Cited

U.S. PATENT DOCUMENTS

| | | | |
|---|---|---|---|
| 4,545,554 | 10/1985 | Latino | 248/118.1 |
| 4,688,862 | 8/1987 | Fowler | 248/118.5 X |
| 4,913,390 | 4/1990 | Berke | 248/918 X |
| 5,072,905 | 12/1991 | Hyatt | 248/118 |
| 5,183,230 | 2/1993 | Walker | 248/118.3 X |
| 5,219,136 | 6/1993 | Hassel | 248/918 X |
| 5,288,042 | 2/1994 | Grimm | 248/918 X |
| 5,320,317 | 6/1994 | Hyatt | 400/715 X |

*Primary Examiner*—J. Franklin Foss
*Attorney, Agent, or Firm*—Nils H. Ljungman & Associates

[57] ABSTRACT

Apparatus for supporting at least one forearm for the operation of keyboards, assembly operation, etc. At least one lever can be fastened to a tabletop or work surface and is connected, by means of at least one locking joint with a pivoting support, to hold a support plate. The joint has two endpieces which can be clamped together, between which there are several plates secured non-rotatably in alternation on different arms of the joint. The support and the lever have at least one pivot located in the joint axis to hold the plates. Every second plate is secured non-rotatably on the pivot. The pivot, together with all the plates, projects into a recess of one endpiece, and the other plates are secured in the recess against rotation.

20 Claims, 5 Drawing Sheets

FIG. 6
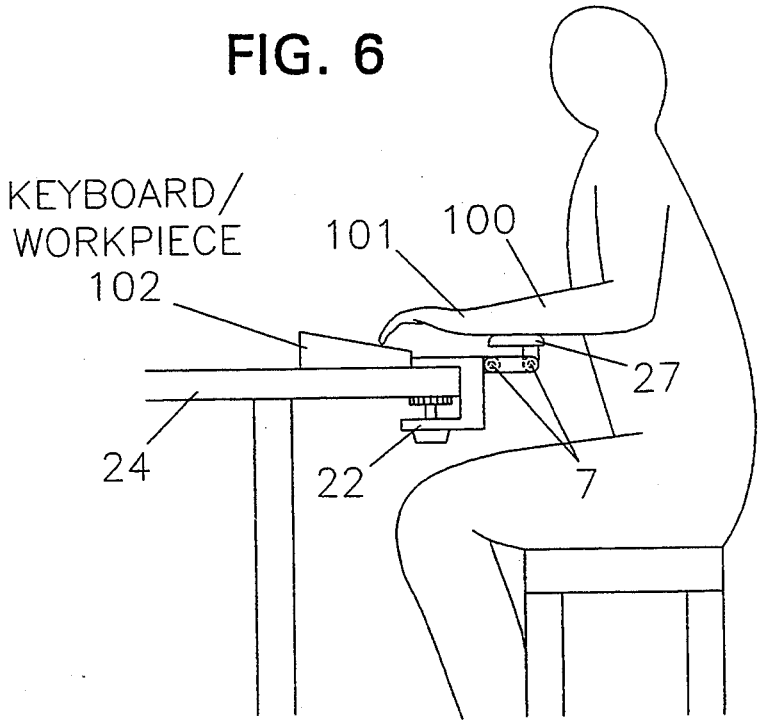
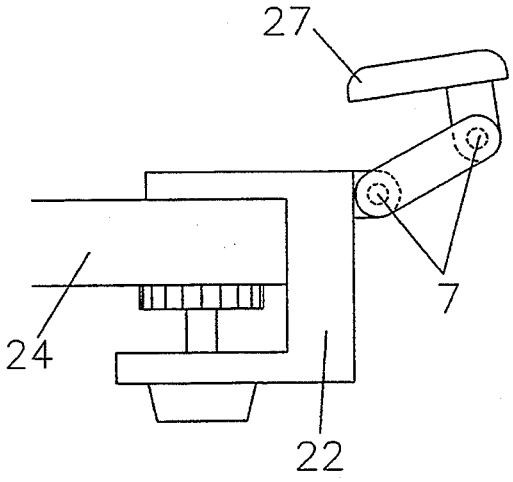
FIG.7a
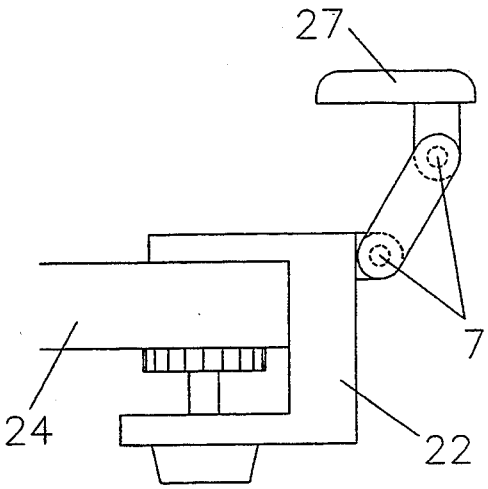
FIG. 7b

FIG. 9
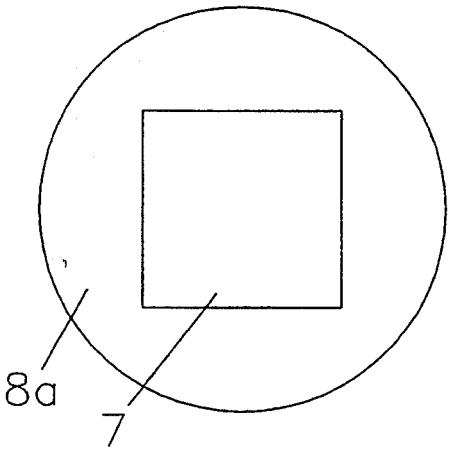
FIG. 10
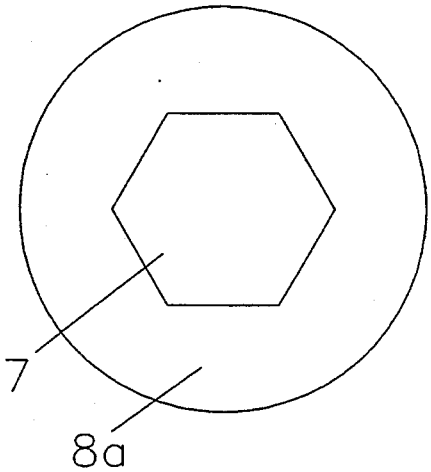
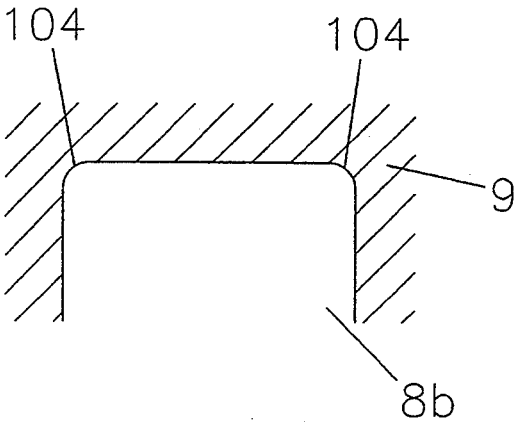
FIG. 11
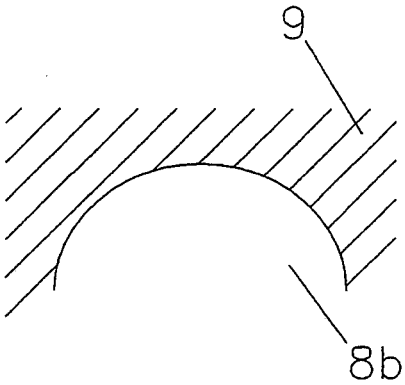
FIG. 12

APPARATUS FOR SUPPORTING A HUMAN FOREARM DURING A WORK OPERATION, SUCH AS A KEYBOARD OPERATION

BACKGROUND OF THE INVENTION

1. Field of the Invention

This invention relates to a device for the support of at least one forearm, i.e. at least one human forearm, for the operation of keyboards, assembly operations etc., having at least one clamp which can be fastened to a tabletop or work surface and which is connected by at least one locking joint, possibly even a hinge, link or articulation, to a pivoting holder which holds a support plate, whereby the joint has two endpieces which can be clamped to one another, between which there are several plates secured in a non-rotating fashion alternately to different articulated arms, or brackets.

2. Background Information

Generally known are devices which are used to support forearms for the operation of keyboards, assembly operations etc. These known devices tend to include a support plate, which is generally cushioned or padded, and which is fastened to a tabletop or work surface. It is thereby desirable that it be possible to position the support plate at different heights and at different inclinations as a function of the size of the object and the working position of the forearm. To be able to change the height and the inclination of the support plate, the support plate must be connected by means of at least one locking double joint to a clamp which can be fastened to the tabletop or work surface. In the unclamped state, the support plate can now be placed at a suitable height and inclination, and can then be secured by a clamping action.

OBJECT OF THE INVENTION

The object of the invention is therefore to configure a device for the support of at least one forearm for the operation of keyboards, assembly operation, etc., so that problems encountered with known fastening arrangements to fasten the plates to the fastening clamp and to the support plate can be eliminated, and so that the plates and their operation essentially will not be adversely affected by dust and dirt. An additional object of the invention is to provide improved visual appearance.

The invention teaches that the above objects can be achieved by means of a device in which the support and the clamp have at least one pivot located in the joint axis to hold the plates, every second plate is secured non-rotationally to the pivot, the pivot together with all the plates project into a recess of one endpiece, and the other plates are secured against rotation in the recess.

As a result of this configuration, a special fastening of the plates corresponding to the fastening clamp and to the support plate is essentially not necessary, so that the assembly process for the manufacture of such a device can be simplified.

Plates which act as a lever with a double joint can be eliminated. The plates will thus essentially be located in a closed recess, so that their clamping function is essentially not adversely affected by dust and dirt. As a result of the concealed location of the plates, the device can have a significantly improved appearance.

In summary, one aspect of the invention resides broadly in apparatus for supporting a first object, such as a human forearm, with respect to a second object, the apparatus comprising: at least one lever; means for fastening the at least one lever to the second object; support means for supporting the first object, the support means being pivotally connected to the at least one lever; joint means for permitting pivotal movement of the at least one lever and the support means with respect to one another; the joint means comprising at least one endpiece connected to the at least one lever; the joint means having means for pivotally connecting the at least one endpiece and the support means with one another; means for locking the joint means to hold the at least one endpiece and the support means in a substantially fixed position with respect to one another; the joint means comprising: a plurality of plates; a lug supporting at least some of the plurality of plates; a recess disposed in one of the first and second endpieces; the lug and the plurality of plates being disposed to project into the recess; a first set of the plurality of plates being secured on the lug so as to be non-rotatable with respect to the lug; a second set of the plurality of plates being secured within the recess so as to be non-rotatable with respect to the recess; and the first set of plates and the second set of plates being disposed in alternation with respect to one another.

BRIEF DESCRIPTION OF THE DRAWINGS

The invention is explained in greater detail below with reference to an embodiment illustrated in the accompanying drawings, wherein:

FIGS. 9 and 10 are schematic, side elevational views of different embodiments of a pivot and plates; and FIGS. 11 and 12 are schematic, side elevational views of different embodiments of a recess and plates.

DESCRIPTION OF THE PREFERRED EMBODIMENTS

Figure 1:
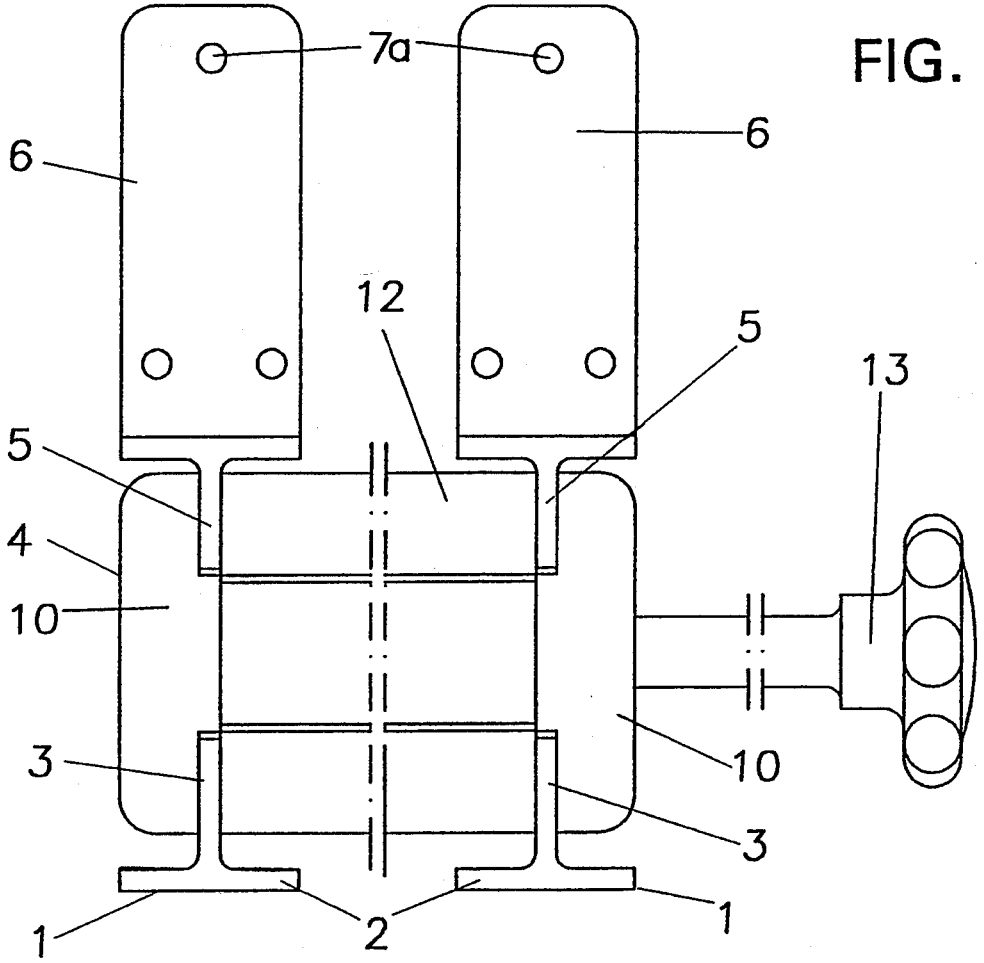
FIG. 1 shows an elevational view of a device as claimed by the invention.
Figure 3:
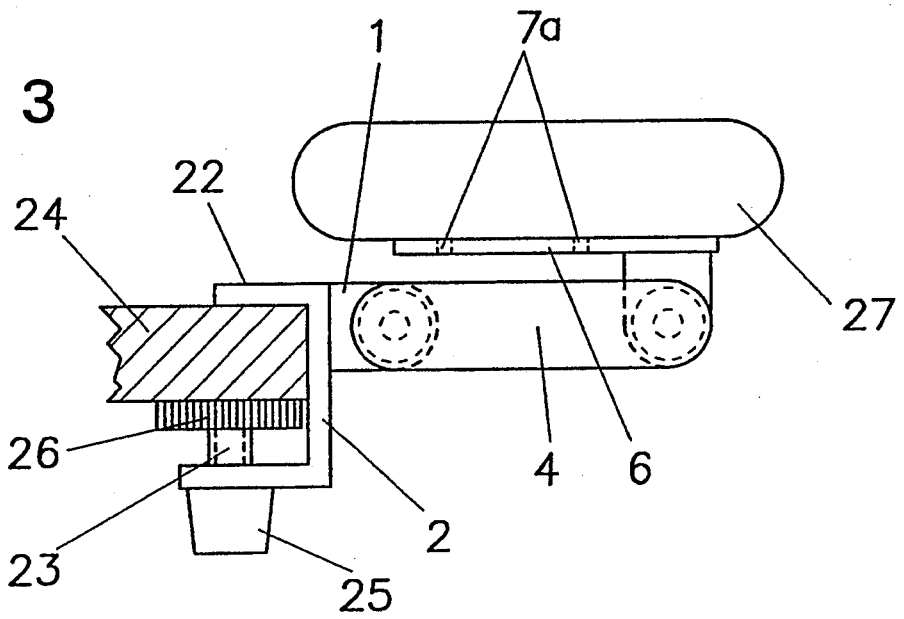
FIG. 3 shows a side view of the device fastened to a tabletop or work surface.

The device illustrated in FIG. 1 of the accompanying drawings can preferably be used to support at least one forearm during the operation of a keyboard, or during assembly operations, etc., on a tabletop or work surface. The device thereby preferably includes two levers 1, which can each have a T-shaped cross section, for example, and which, in the vicinity of their webs 2, are each preferably designed as a clamp 22 (see FIG. 3). Preferably, clamps 22 are each fastened to a tabletop or work surface 24 (see FIG. 3) by clamping, e.g. by means of screws 23. The screws 23 are preferably inserted in rotational fashion in an extension 25, and on their upper or exposed end preferably support a plate 26 provided with a knurled area, by means of which the screw 23 can be turned; thus, the device can be clamped firmly to the tabletop or work surface (FIG. 3).

The legs 3 of the lever 1 are preferably connected by means of a double joint 4, in hinged fashion, with legs 5, respectively, of a plate-like support 6. Legs 5 are preferably provided with holes 7*a* for fastening a support plate 27. The support plate 27 is preferably in contact with, or supports, the forearm, and is preferably cushioned or upholstered, whereby a flexible layer of rubber or a similar material can be provided in the support plate.

Figure 2:
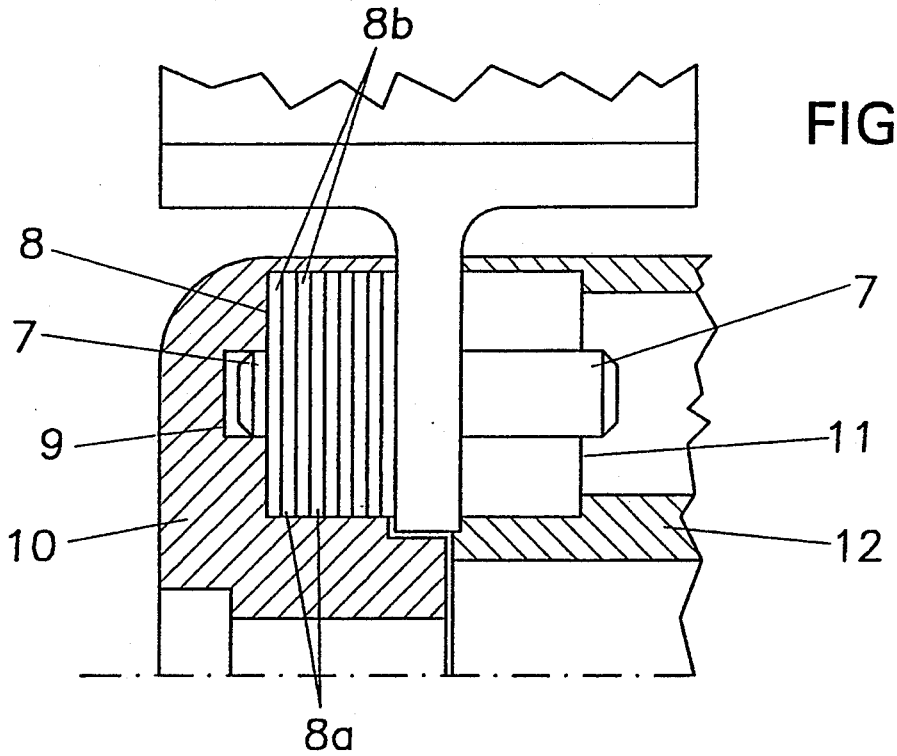
FIG. 2 shows an enlarged cross section through a joint of the device illustrated in FIG. 1.

In the illustrated example, as shown in FIG. 2, on the leg 5 of a support 6, each leg 3, 5 preferably has on each side a pivot 7, which in this embodiment preferably has a square cross section. Located on each pivot 7 there are preferably several plates 8, whereby, for purposes of illustration in FIG. 2, these plates are shown only on the left pivot 7. The right pivot 7 shown in the drawing can also be equipped with plates 8 in a similar manner.

In accordance with at least one preferred embodiment of the present invention, each pivot 7 may alternatively be considered to be a "pin", "journal", or "lug".

All the plates 8 preferably have a central opening which makes it possible to insert the plates on the pivot 7. But this opening is preferably different in the plates 8. Particularly, in accordance with a preferred embodiment of the present invention, every second plate 8*a* preferably has an opening which coincides essentially exactly with the cross section of the pivot 7, so that these plates 8*a* are essentially secured non-rotationally on the pivot 7. The other plates 8*b* preferably have an opening which is the same as, or slightly larger than, the width across the corners, possibly diameter, of the pivot 7. That means that the plates 8*b* can rotate on, essentially with respect to, the pivot 7.

Thus, in accordance with a preferred embodiment of the present invention, plates 8 are preferably constituted by a first set of plates 8*a* and a second set of plates 8*b*, which plates 8*a* and 8*b* preferably alternate with one another along the longitudinal direction of pivot 7. Preferably, plates 8*a* each have an opening which is of a size such that, when pivot 7 is introduced therethrough, each plate 8*a* will essentially be secured non-rotationally with respect to pivot 7. Accordingly, such non-rotational securing may be accomplished, for example, by a force-locking relationship between each plate 8*a* and the pivot 7. Conversely, plates 8*b* each preferably have an opening which is of a sufficient size such that, when pivot 7 is introduced therethrough, each plate 8*b* will essentially be rotatable with respect to pivot 7.

In the illustrated embodiment, the plates 8*a* preferably have a circular outer contour. But, in accordance with a preferred embodiment of the present invention, the plates 8*b* can preferably have a contour which is different from that of the plates 8*a*. The outer contour of the plates 8*b* can be square, for example, and the corners of the square outside contour can preferably be rounded. The length of a side of this square is preferably approximately equal to the diameter of the plates 8*a*. The plates 8*b* can also conceivably have an area, i.e. a general base or outline, which is embodied by a semicircle and a rectangle.

Thus, in accordance with a preferred embodiment of the present invention, the plates 8*b* can conceivably have an outer contour, such as a generally square contour, which is different from that of plates 8*a*. For example, plates 8*b* could conceivably even have an outer contour which is semicircle in one half of the plate, and generally rectilinear/rectangular in the other half.

The pivot 7 equipped with the plates 8 now essentially projects into a graduated recess 9 of an endpiece 10. The smaller cross section of the recess 9 can thereby preferably be slightly larger than the width across the corners, possibly diameter, of the pivot 7, so that the pivot 7 can be rotatable within the recess 9. The larger cross section of the recess 9 preferably essentially exactly equals the area of the plates 8*b*, so that the latter are preferably secured non-rotationally in the recess 9.

Thus, in accordance with a preferred embodiment of the present invention, plates 8*b* each preferably have an outer contour which is of a size such that, when plates 8*b* are introduced into recess 9, each plate 8*b* will essentially be secured non-rotationally with respect to recess 9. Accordingly, such non-rotational securing may be accomplished, for example, by a force-locking relationship between each plate 8*b* and the recess 9. Conversely, plates 8*a* each preferably have an outer contour which is of a size such that, when plates 8*a* are introduced into recess 9, each plate 8*a* will essentially be rotatable with respect to recess 9.

The pivot 7, or portion of pivot 7, in FIG. 2 which is not loaded with plates, preferably projects into a recess 11 in a spacer 12, which spacer 12 is preferably located between the neighboring legs 3 and 5 of the lever 1 and the support 6. The cross section of the recess 11 in the spacer 12 is preferably essentially exactly equal to the larger cross section of the graduated recess 9 in the endpiece 10.

To form the device, all the pivots 7 are preferably loaded in alternation with the different plates 8*a*, 8*b*, and are preferably inserted in the corresponding recesses 9, 11. All the plates 8*a* are preferably secured non-rotationally on the pivots 7, while all the plates 8*b* are preferably held non-rotationally in the recesses 9, 11. In what may be designated the "unclamped" state, the lever 1 and the support 6 are preferably turned or pivoted freely within the limits of their specified pivoting range. By means of a clamping element 13, e.g. designed as a screw, the two endpieces 10 can now essentially be clamped together. Consequently, all the plates 8 are preferably thence clamped together, and the position of the support 6 with the support plate 27 can thus preferably be secured in an essentially precisely defined position in relation to the levers 1 fastened to the tabletop of work surface 24.

If necessary, the clamping element 13 designed as a screw can preferably be divided and can be embodied by a pin provided with a thread, and a sleeve which can be pushed partly over the pin. The revolving joint between the sleeve and the pin can preferably be accomplished by means of a pivot which is stuck through, whereby the pin can have a slot which runs in the axial direction to hold the pivot. It is thereby possible to limit the opening motion of the endpieces 10 and thus to essentially guarantee that the plates 8 essentially cannot escape from the corresponding recesses 9, 11.

Figure 4:
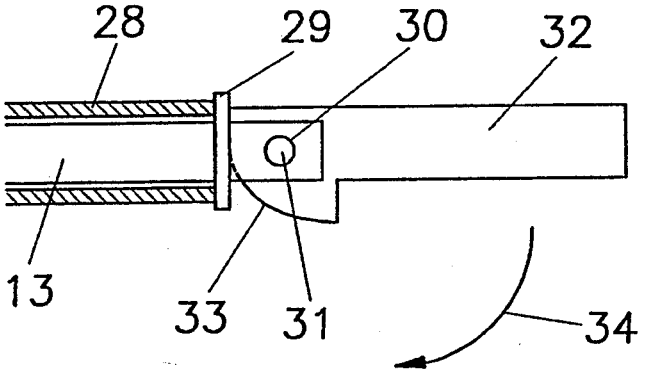
FIG. 4 shows a clamping device which is designed as a cam.

In the embodiment illustrated in FIG. 4, the clamping element 13 is not designed as a screw. In FIG. 4, the clamping element 13 is guided in a sleeve 28 which is supported with its one end of the endpiece 10 to the right in the figure, while the other end supports a clamping plate, possible backplate, 29, through which the clamping element 13 projects. In this area, the clamping element 13 can be designed with a fork-like configuration, and can have a hole 30 for a pivot 31. A tension lever 32 is also mounted on the pivot 31 and has a clamping surface 33 which preferably acts as a cam and can be pivoted around the pivot 31. During this pivoting motion, the clamping element 13 is preferably displaced axially, and thus the plates 8*a*, 8*b* are clamped together.

Figure 5:
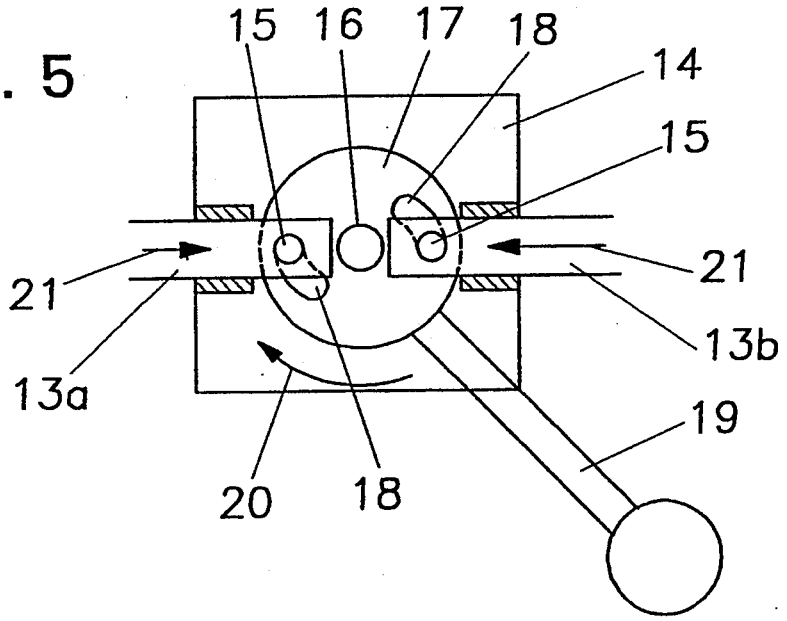
FIG. 5 shows another clamping device which also acts as a cam, FIG. 6 schematically illustrates a human engaged in a work operation with a device according to the present invention, FIGS. *7a* and *7b* illustrate different positions of a device according to the present invention.

The clamping capabilities illustrated in FIGS. 1 and 3 are normally only generally suitable for use by right-handed people. For left-handed people, the clamping element 13 should preferably be located on the left side of the device, which would, under certain circumstances, tend to imply that two different devices may be necessary. But in this case, FIG. 5 illustrates a solution which can be correctly operated by left-handed people and by right-handed people. The clamping element 13 is preferably divided into a left-hand part 13*a* and a right-hand part 13*b*, both of which are preferably guided on a plate 14. Each part 13*a*, 13*b* preferably has a fork-shaped end with a pivot 15 and preferably holds a common disc 17 which can rotate around an axis 16. The disc 17 is preferably provided with two grooves 18 which can preferably act as cams, into which the pivots 15 are preferably inserted. When the disc 17 is rotated by means of a lever 19 in the direction indicated by the arrow 20, the two parts 13*a*, 13*b* of the clamping element 13 are preferably displaced in the direction indicated by the two arrows, thereby executing the clamping movement.

In a modification of the embodiment explained above, the plates 8 can have a different shape or area. In such a case, however, it should essentially always preferably be guaranteed that the plates 8*a* are non-rotationally secured on the pivot 7 and the plates 8*b* are non-rotationally secured in the recess 9, 11. If the clamping with one packet of plates 8 on each leg 3, 5 is sufficient, the leg 3, 5 can have a pivot 7 only on one side, the corresponding recess 9 or 11—generally the recess 11—can be eliminated. The levers 1 which are used to fasten the device to a tabletop or work surface can be designed in a different manner, and consequently can also be fastened to the tabletop or work surface in another manner.

FIG. 6 schematically illustrates, in accordance with a preferred embodiment of the present invention, a human forearm 100 positioned on support plate 27, a wrist 101 and a keyboard or workpiece 102, as well as other components.

FIGS. 7*a* and 7*b* schematically illustrate, in accordance with a preferred embodiment of the present invention, that, generally, the angle and/or height of the support plate 27 can be adjusted as a function of the position of the forearm for each individual user or activity.

Figure 8:
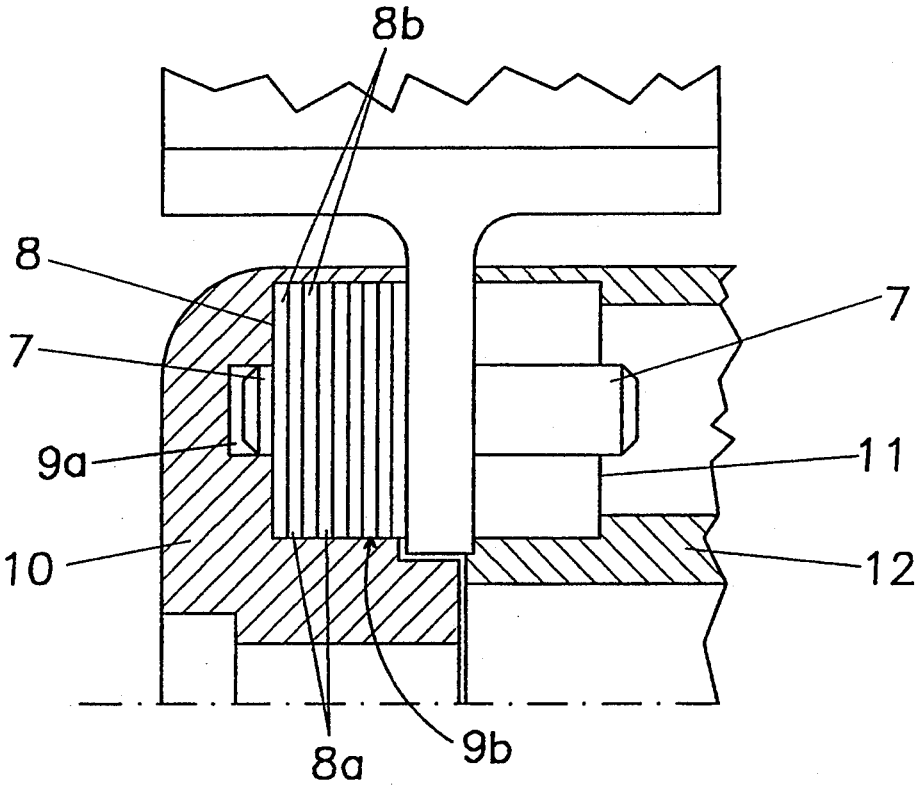
FIG. 8 is substantially the same view as FIG. 2, but more detailed.

FIG. 8 more particularly illustrates the graduated recess 9 as discussed hereinabove. Particularly, recess 9, in accordance with a preferred embodiment of the present invention, can preferably be constituted by a recess section 9*a* of smaller diameter and/or cross-sectional area and an adjacent recess section 9*b* of greater diameter and/or cross-sectional area. As discussed hereinabove, in accordance with a preferred embodiment of the present invention, pivot 7 can preferably be configured so as to be rotatable within smaller recess section 9*a*.

FIG. 9 illustrates that, in accordance with a preferred embodiment of the present invention, pivot 7 can preferably have a generally square cross-sectional shape, which would preferably translate into a generally similar square cross-sectional shape of the hole of each plate 8*a*.

FIG. 10 illustrates that, in accordance with another preferred embodiment of the present invention, pivot 7 can preferably have a generally hexagonal cross-sectional shape which would preferably translate into a generally similar hexagonal cross-sectional shape of the hole of each plate 8*a*.

FIG. 11 illustrates that, in accordance with a preferred embodiment of the present invention, recess 9 can preferably have a generally square internal cross-sectional shape, with rounded corners 104, for accommodating plates 8*b*.

FIG. 12 illustrates that, in accordance with another preferred embodiment of the present invention, recess 9 can preferably have a generally oval internal cross-sectional shape for accommodating plates 8*b*.

One feature of the invention resides broadly in the device for supporting at least one forearm for the operation of keyboards, assembly operations etc., consisting of at least one lever which can be fastened to a tabletop or work surface and which is connected by means of at least one locking joint with a pivoting support to hold a support plate, whereby the joint has two endpieces which can be clamped together, between which there are several plates secured non-rotationally in alternation on different arms of the joint, characterized by the fact that the support 6 and the lever 1 have at least one pivot 7 located in the joint axis to hold the plates 8, that every second plate 8*a* is secured non-rotationally on the pivot 7, that the pivot 7, together with all of the plates 8, projects into a recess 9 of one endpiece 10, and that the other plates 8*b* are secured in the recess 9 against rotation.

Another feature of the invention resides broadly in the device, characterized by the fact that the support 6 and the clamp 1 have a pivot 7 on both sides.

Yet another feature of the invention resides broadly in the device, characterized by the fact that the pivot 7 has a polygonal cross section and the plates 8*a* secured non-rotationally on the pivot 7 have an opening with the same cross section.

Still another feature of the invention resides broadly in the device, characterized by the fact that the pivot 7 has a square or hexagonal cross section.

Yet still another feature of the invention resides broadly in the device, characterized by the fact that the recess 9, 11 has a polygonal or oval cross section, and the plates 8*b* secured non-rotationally in it have the same area.

Still yet another feature of the invention resides broadly in the device, characterized by the fact that the corners of the recess 9, 11 and of the plates 8*b* are rounded.

Another feature of the invention resides broadly in the device, characterized by the fact that a spacer 12 is located between the two endpieces 10.

Still another feature of the invention resides broadly in the device, characterized by the fact that the spacer 12 also has a recess 11, at least on one end surface.

Still yet another feature of the invention resides broadly in the device, characterized by the fact that the plates 8 can be clamped together by means of a screw or a cam, to the endpieces 10 and, if necessary, to the spacer 12.

Examples of keyboard arrangements, which may be utilized in accordance with the embodiments of the present invention, may be found in the following U.S.

Pat. Nos. 4,890,561, which issued to Hampshire et al. on Jan. 2, 1990; No. 5,118,172, which issued to Ugalde on Jun. 2, 1992; and No. 5,294,087, which issued to Drabczyk et al. on Mar. 15, 1994.

Examples of arrangements for assembly operation, which may be utilized in accordance with the embodiments of the present invention, may be found in the following U.S. Pat. Nos. 5,082,038, which issued to Teel on Jan. 21, 1992; and No. 5,251,501, which issued to Katahira on Oct. 12, 1993.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. G 93 11 467.2, filed on Jul. 31, 1993, having inventor Rainer Schmidt, and DE-OS G 93 11 467.2 and DE-PS G 93 11 467.2, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Apparatus for supporting a first object, such as a human forearm, with respect to a second object, said apparatus comprising:
- at least one lever;
- means for fastening said at least one lever to the second object;
- support means for supporting the first object, said support means being pivotally connected to said at least one lever;
- joint means for permitting pivotal movement of said at least one lever and said support means with respect to one another;
- said joint means comprising at least one endpiece connected to said at least one lever;
- said joint means having means for pivotally connecting said at least one endpiece and said support means with one another;
- means for locking said joint means to hold said at least one endpiece and said support means in a substantially fixed position with respect to one another;
- said joint means comprising:
  - a plurality of plates;
  - a lug supporting at least some of said plurality of plates;
  - a recess disposed in one of said first and second endpieces;
  - said lug and said plurality of plates being disposed to project into said recess;
  - a first set of said plurality of plates being secured on said lug so as to be non-rotatable with respect to said lug;
  - a second set of said plurality of plates being secured within said recess so as to be non-rotatable with respect to said recess; and
  - said first set of plates and said second set of plates being disposed in alternation with respect to one another.

2. The apparatus according to claim 1, wherein said joint means comprises additional lug means, said additional lug means having means for pivotally connecting said at least one endpiece and said at least one lever with one another.

3. The apparatus according to claim 2, wherein:
- each of said plurality of plates has an opening disposed therethrough;
- said lug is disposed through said openings of said plurality of plates;
- said lug has a polygonal cross-sectional shape; and
- said opening in each of said first set of plates is polygonal and is substantially the same size and substantially the same shape as the polygonal cross-sectional shape of said lug.

4. The apparatus according to claim 3, wherein said lug has one of:
- a generally square cross-sectional shape; and
- a generally hexagonal cross-sectional shape.

5. The apparatus according to claim 4, wherein:
- said recess has a cross-sectional shape;
- each of said second set of said plates has an outer cross-sectional shape; and
  - said outer cross-sectional shape of each of said second set of plates has a is substantially the same size and substantially the same shape as the polygonal cross-sectional shape of said recess.

6. The apparatus according to claim 5, wherein:
- the cross-sectional shape of said recess and the outer cross-sectional shape of each of said second set of plates are one of:
  - oval; and
  - polygonal with rounded corners.

7. The apparatus according to claim 6, further comprising a spacer disposed between said first endpiece and said second endpiece.

8. The apparatus according to claim 7, wherein:
- said spacer has an additional recess disposed therein;
- said additional recess of said spacer has substantially the same cross-sectional shape of said recess of said one of said first and second endpieces; and
- said lug additionally projects into said additional recess.

9. The apparatus according to claim 8, wherein:
- said means for locking said joint means comprises means for clamping said plurality of plates with respect to at least one of:
  - said one of said first and second endpieces; and
  - said spacer; and
- said clamping means comprises one of:
  - screw means; and
  - cam means.

10. The apparatus according to claim 1, wherein:

each of said plurality of plates has an opening disposed therethrough;

said lug is disposed through said openings of said plurality of plates;

said lug has a polygonal cross-sectional shape; and said opening in each of said first set of plates is polygonal and is substantially the same size and substantially the same shape as the polygonal cross-sectional shape of said lug.

11. The apparatus according to claim 10, wherein said lug has one of:

a generally square cross-sectional shape; and a generally hexagonal cross-sectional shape.

12. The apparatus according to claim 11, wherein:

said recess has a cross-sectional shape;

each of said second set of said plates has an outer cross-sectional shape; and said outer cross-sectional shape of each of said second set of plates has a is substantially the same size and substantially the same shape as the polygonal cross-sectional shape of said recess.

13. The apparatus according to claim 12, wherein:

the cross-sectional shape of said recess and the outer cross-sectional shape of each of said second set of plates are one of:

oval; and polygonal with rounded corners.

14. The apparatus according to claim 13, further comprising a spacer disposed between said first endpiece and said second endpiece.

15. The apparatus according to claim 14, wherein:

said spacer has an additional recess disposed therein;

said additional recess of said spacer has substantially the same cross-sectional shape of said recess of said one of said first and second endpieces; and said lug additionally projects into said additional recess.

16. The apparatus according to claim 15, wherein:

said means for locking said joint means comprises means for clamping said plurality of plates with respect to at least one of:

said one of said first and second endpieces; and said spacer; and said clamping means comprises one of:

screw means; and cam means.

17. The apparatus according to claim 10, wherein:

said recess has a cross-sectional shape;

each of said second set of said plates has an outer cross-sectional shape; and said outer cross-sectional shape of each of said second set of plates has a is substantially the same size and substantially the same shape as the polygonal cross-sectional shape of said recess.

18. The apparatus according to claim 17, wherein:

the cross-sectional shape of said recess and the outer cross-sectional shape of each of said second set of plates are one of:

oval; and polygonal with rounded corners.

19. The apparatus according to claim 18, further comprising a spacer disposed between said first endpiece and said second endpiece.

20. The apparatus according to claim 19, wherein:

said spacer has an additional recess disposed therein;

said additional recess of said spacer has substantially the same cross-sectional shape of said recess of said one of said first and second endpieces;

said lug additionally projects into said additional recess;

said means for locking said joint means comprises means for clamping said plurality of plates with respect to at least one of:

said one of said first and second endpieces; and said spacer; and said clamping means comprises one of:

screw means; and cam means.

* * * * *